US005369829A

United States Patent [19]

Jay

[11] Patent Number: 5,369,829

[45] Date of Patent: Dec. 6, 1994

[54] SEAT CUSHION FOR RECLINING WHEELCHAIRS

[75] Inventor: Eric C. Jay, Boulder, Colo.

[73] Assignee: Jay Medical, Ltd., Boulder, Colo.

[21] Appl. No.: 231,896

[22] Filed: Apr. 22, 1994

Related U.S. Application Data

[63] Continuation of Ser. No. 138,618, Oct. 18, 1993, abandoned, which is a continuation of Ser. No. 32,626, Mar. 17, 1993, abandoned, which is a continuation of Ser. No. 901,520, Jun. 19, 1992, abandoned, which is a continuation of Ser. No. 194,494, May 16, 1988, abandoned.

[51] Int. Cl.[5] ..... A47C 7/02

[52] U.S. Cl. ..... 5/654; 5/909; 297/DIG. 4; 297/452.41

[58] Field of Search ..... 5/653, 654; 297/459, 297/DIG. 4, 452.41

[56] References Cited

U.S. PATENT DOCUMENTS

| | | | |
|---|---|---|---|
| 1,332,933 | 3/1920 | Sylvester . | |
| 2,997,100 | 8/1961 | Morris | 5/348 |
| 3,000,020 | 9/1961 | Lombard et al. | 5/653 |
| 3,112,956 | 12/1963 | Schick et al. | 297/452.41 |
| 3,503,649 | 3/1970 | Johnson | 5/653 |
| 3,611,455 | 4/1969 | Gottfried | 5/348 |
| 3,702,484 | 11/1972 | Tobinick et al. | 5/348 |
| 3,870,450 | 3/1975 | Graebe | 425/269 |
| 3,965,508 | 6/1976 | Hunter | 5/368 |
| 3,987,507 | 10/1976 | Hall | 5/653 |
| 4,005,236 | 1/1977 | Graebe | 428/72 |
| 4,370,769 | 2/1983 | Herzig et al. | 297/452.41 |
| 4,497,517 | 2/1985 | Gmeiner et al. | 297/452.41 |
| 4,555,140 | 11/1985 | Nemoto | 297/452.41 |
| 4,643,481 | 2/1987 | Saloff et al. | 297/458 |
| 4,726,624 | 2/1988 | Jay | 5/654 |
| 4,912,788 | 4/1990 | Lonardo | 5/653 |
| 5,018,790 | 5/1991 | Jay | 5/653 |

*Primary Examiner*—Eric K. Nicholson
*Attorney, Agent, or Firm*—W. Scott Carson

[57] ABSTRACT

A seating system for a wheelchair including a base member and fluid pad. The base member has forward and rearward sections respectively supporting the user's thighs and buttocks. The rearward section supporting the user's buttocks includes a depressed, seating well with front and rear upper surfaces. The fluid pad has a front-to-rear, center seal and a transverse seal dividing the pad into four pouches. The transverse seal crosses the center seal substantially closer to the rear of the pad than to the front and substantially midway across the seating well. In use, the pad is positioned on the base member wherein the user's thighs and front of the user's buttocks are supported on the forward pouches which, in turn, are positioned over the forward section of the base member and the front portion of the seating well of the base member. The remaining, rear portion of the user's buttocks is supported on the rear pouches over the rear portion of the base member.

31 Claims, 3 Drawing Sheets

A
37
56
39"
37'
54
39'
39
R
F
B
37"
30
27"
36
20
27'
37'
R
F
B
37"
36
30
27"
A
27
34

SEAT CUSHION FOR RECLINING WHEELCHAIRS

This is a continuation of application Ser. No. 138,618 filed Oct. 18, 1993 now abandoned, which is a continuation of application Ser. No. 032,626 filed Mar. 17, 1993, now abandoned, which is a continuation of application Ser. No. 901,520 filed Jun. 19, 1992, now abandoned, which is a continuation of application Ser. No. 194,494 filed May, 16 1988, now abandoned.

BRIEF DESCRIPTION OF THE INVENTION

The invention relates to a seat cushion for use in reclining wheelchairs. The cushion comprises a pad comprising a flexible envelope containing a fluid filling material, which pad is adapted to be used in combination with a shaped tray. The pad is partitioned or segmented to limit the flow of the fluid filling material in selected areas of the pad. In the preferred embodiment, the envelope of the pad is an extensible elastomeric material. The seat cushion of the present invention is a modification of the seat cushion described and claimed in Applicant's U.S. Pat. Nos. 4,588,229 and 4,726,624.

BACKGROUND OF THE INVENTION

Patients who are immobilized for any number of reasons are prone to develop pressure sores at any point in the body wherein a load bearing bone of the body is adjacent to the underlying support structure. Pressure sores are defined as localized areas of necrotic tissue over bony prominences. Particularly susceptible to pressure sores are patients who are victims of spinal cord injury. Also at risk are stroke, hip fracture and brain injury victims, as well as paraplegics, and geriatrics. The successful cure of pressure sores requires daily care and debridement for a period of many months. In some cases, surgical skin grafting is necessary. The apparent problems and costs of treating a single pressure sore are great and therefore prevention must be considered a prime factor.

It has been estimated, that when seated on a flat surface, up to 75% of a person's body weight is distributed over an area covering only four square inches. This is the area of the ischia or seat bones. For a person weighing 150 pounds, this means as much as 110 pounds pressure is distributed over four square inches, or over 25 pounds per square inch pressure. It is also estimated that the capillary blood pressure, when seated, is about 40 millimeters of mercury or about 0.8 pounds per square inch. If pressures higher than 40 millimeters of mercury are developed during sitting, it is obvious that flow of blood through the capillaries can be restricted, which produces a much higher probability of developing pressure sores or decubitus ulcers.

The prior art has attempted to relieve the occurrence of pressure sores on the human body by supporting the human body on large bodies of liquid, to distribute the supporting force uniformly all over the supported body. These attempts have been successful to a limited extent. However, in order to provide for complete support, it is necessary to displace a weight of liquid equal to the weight of the body being supported. Consequently, such systems are very heavy and are difficult to employ even in beds. Moreover, such heavy liquid cushioning devices have been found difficult to manipulate by patients who utilize wheelchairs to afford them a reasonable degree of mobility and independence, particularly when it is necessary to fold a wheelchair up when it is transferred by automobile.

The prior art patents have disclosed the use of air bags and airtight envelopes which sometimes include a mass of compressible, resilient material to augment the support, see for example U.S. Pat. Nos. 1,332,933, 2,997,100, 3,870,450 and 4,005,236. Other systems have included elastomeric foams which are filled with liquids, see for example U.S. Pat. Nos. 3,611,455, 3,702,484 and 3,965,508. While both of the liquid and gas (air) systems have been successful to some extent in distributing the body load over a wider surface of the body, both suffer from inherent disadvantages. Those fluid filled systems which rely on airtight or watertight envelopes are subject to inadvertent punctures and deflation with the resulting rapid loss of support. The systems based on the use of liquid fillings are invariably heavy and are difficult to use in a wheelchair or other ambulatory devices. Moreover, the systems which rely on air or other gas for support need frequent adjustment to compensate for temperature variations, pressure variations (such as caused by altitude changes) and the weight of the user.

In addition to the foregoing problems, the prior art eat cushions do not provide sitting stability or posture support to the user. Problems with seat stability are particularly critical with respect to wheelchair users. A cushion which provides a stable seating enhances the user's ability to wheel and turn the chair by grasping the wheels, to get in and out of the chair, to reach the floor to pick up an object from the floor and other types of movements. A cushion which provokes non-stability or a fear of falling from the chair will inhibit the user's range of movement. However, a seat cushion which provides a stable and comfortable seat will improve the user's equilibrium and sense of orientation.

Many of the prior art cushions which provide improved pressure distribution, such as those filled with liquid or with other fluids, are not longitudinally divided. Accordingly, when people lean to one side or the other, which is the usual tendency, the fluid moves away from the lower side and into the higher side of the cushion, exaggerating the tendency to lean. This results in the person not only leaning more on a fluid filled cushion than a solid cushion, but it creates a feeling of instability and a fear of leaning to one side because of the instability which is likely to follow.

The prior art seat cushions have also failed to effectively deal with the problem of slumping. The prior art devices have no provision to prevent the ischial tuberosities from gradually sliding forward, which results in slumping to the point where the person's posture becomes bad. The consequences of slumping include increased pressure on the coccyx and, if carried to extreme, a tendency to slip off the cushion and possibly out of the wheelchair.

The seat cushions described and claimed in Applicant's U.S. Pat. Nos. 4,588,229 and 4,726,624 have successfully dealt with most of the foregoing problems, as is evidenced by the commercial success therein. However, an additional problem has been observed when such cushions are used in wheelchairs with reclining backs. Such wheelchairs have provisions allowing the back to be tilted backwardly, thus allowing the patient to recline. This shifts the center of gravity of the patient to the rear in the wheelchair. It has been discovered that in the reclining position, the rearward position of the patient's weight tends to cause the flowable fluid filling material to flow to the forward portion of the pad, which allows for bottoming out of the patient when the patient is returned to the normal seating position. In addition, a patient slouches excessively can cause the fluid to pool behind his ischial tuberosities, causing a bottoming-out and a resulting pressure sore. Although the flowable fluid may be worked back to the rear of the cushion, damage from the bottoming-out problem can occur before the patient is aware of the problem.

The seat cushion of the present invention overcomes the foregoing problems as is more fully described below.

SUMMARY OF THE INVENTION

The present invention relates to seat cushions for human beings and more particularly to a pad comprising a flexible envelope containing a fluid filling material, wherein a pad is transversely segmented to cause a portion of the fluid filling material to be confined in the rearmost portion of the pad. Although the pad may be used by itself on any surface, in the preferred embodiment the pad is used in combination with a relatively rigid tray which is shaped to build supporting pressure in the desired areas, and thus distribute the load of the human body over a sufficiently wide area of the body being supported in order to avoid the formation of pressure sores.

In the preferred embodiment, the flexible envelope is transversely divided or segmented by securing the upper surface of the envelope to the lower surface of the envelope from side to side in order to prevent the fluid filling material from passing from back to front. This construction avoids the problems associated with the person's reclining backwardly and provides a substantially more supportive seat cushion.

In order to avoid the problem with hammocking, it is necessary that either the upper surface of the envelope be fabricated from an elastic material and/or that the envelope be substantially wider than the upper surface of the accompanying tray. Hammocking is defined as a suspension of the bony prominences of the user on the surface of the cushion, thereby preventing total confirmation of the cushion to the user's body and preventing complete pressure equalization. The present invention contemplates the use of the elastomeric upper surface of the envelope, whereby the surface will stretch in response to the pressure from the bony prominences, thereby distributing the pressure ever a larger area.

In the preferred embodiment, the pad is shaped to extend laterally beyond both sides of the tray near the back of the pad, so that when the pad is placed on the tray it takes on a somewhat pleated appearance in the ischia supporting area. It has been found that the pleated pad conforms better to the bones, and when used in combination with the shaped tray provides for somewhat higher pressure along the sides of the user's body and thus distributes the user's weight on the cushion more evenly, as determined by relatively equal pressures measured across the user's bottom. This provides for comfortable support even for persons having bony protrusions from their ischia. The lateral extension may be confined to the upper surface of the envelope, although the present invention contemplates the extension of both the upper and lower surfaces. Although any amount of extension will provide some improvement, it is preferred that the upper surface be at least 25% wider than the width of the tray.

The present invention contemplates reduction of the hammocking problem by either the use of elastomeric material alone or by using a substantially wider envelope alone or by using a combination of the two methods.

In one embodiment, the flexible envelope, adapted to contain the fluid filling material, is fabricated from an extensible elastomeric material, such as thermoplastic polyurethane film. The use of an elastomeric envelope and/or excess film minimizes the build-up of pressures over bony prominences, and thus avoids the hammocking problem which is associated with inextensible supporting materials. The fluid filling material is preferably a high viscosity, thixotropic material which will flow under pressure, but which will maintain its shape in the absence of pressure.

The flexible envelope containing the fluid filling material is anchored to the underlying tray or chair in such a manner that it is restrained from sliding forward. This anti-sliding restraint, in combination with other seat design features described herein, reduces the tendency of the user to slide forward and the consequential slumping. Basically, through fastening the cushion, the tendency of the cushion to slip forward is obviated and the consequent tendency of the user to slump is substantially eliminated.

Moreover, the other features of the cushion also cooperate to reduce the tendency to slump. It is well known that slumping is a reaction to non-stability. An envelope filled with a non-compressible thixotropic filling produces a much more staple seat, which decreases the tendency toward slumping which occurs when a person is seated on an unstable surface. Moreover, in the preferred embodiment, the tray which has a slightly raised portion for the legs and a depressed portion for the ischial tuberosities also has a marked tendency to reduce the tendency to slump, as the seat portion of the cushion is slightly lower than the leg portion in the preferred embodiment. Adding the transverse segment across the back of the cushion further decreases the tendency to slump and reduces the probability of bottoming out as a result of pooling of the fluid behind the ischials.

In the preferred embodiment, the pad described above is used in combination with a relatively rigid, shaped tray. The shaped tray has upwardly extending rims on both sides and a modified rim at the front (with areas to accommodate the legs of the user of the cushion), but the tray is open in the rear to avoid placing any pressure on the ischial tuberosities (seat bones) or the coccyx (tail bone), or the back during reclining. The opening in the rear should be at least six inches wide, and may extend across the entire width of the tray. Preferably, the front rim is deep enough (as measured from front to back) to provide support for the user's legs and includes two areas of somewhat reduced elevation to accommodate the user's legs. The rims of the tray function to generate supporting pressures, through the flowable filling material, in areas of the body other than the ischia or seat bones.

In this embodiment, it is preferred that the pad be removably attached to the tray along the rims at the sides and near the back. It is considered to be important to affix the pad to the tray at the back where there is no rim (in order to accommodate the tail bone) in order to avoid slippage of the pad off the ischia supporting area. It is contemplated that this system Df attachment permits the pad to more uniformly distribute the supporting pressure across the user's entire bottom surface.

The use of a pad which is a separate component from the tray is desired for several reasons. The separate components allow the pad to be removed for cleaning and permits the pad to be used without the tray, such as in the operation of an automobile where the height created by the tray might end to interfere with the steering wheel. Moreover, the use of a separate tray enhances the ability of the user to create a customized construction, wherein a portion of the tray can be cut away or built up. The separate component construction also provides for separate replacement in the event of damage.

DETAILED DESCRIPTION OF THE INVENTION

Figure 1:
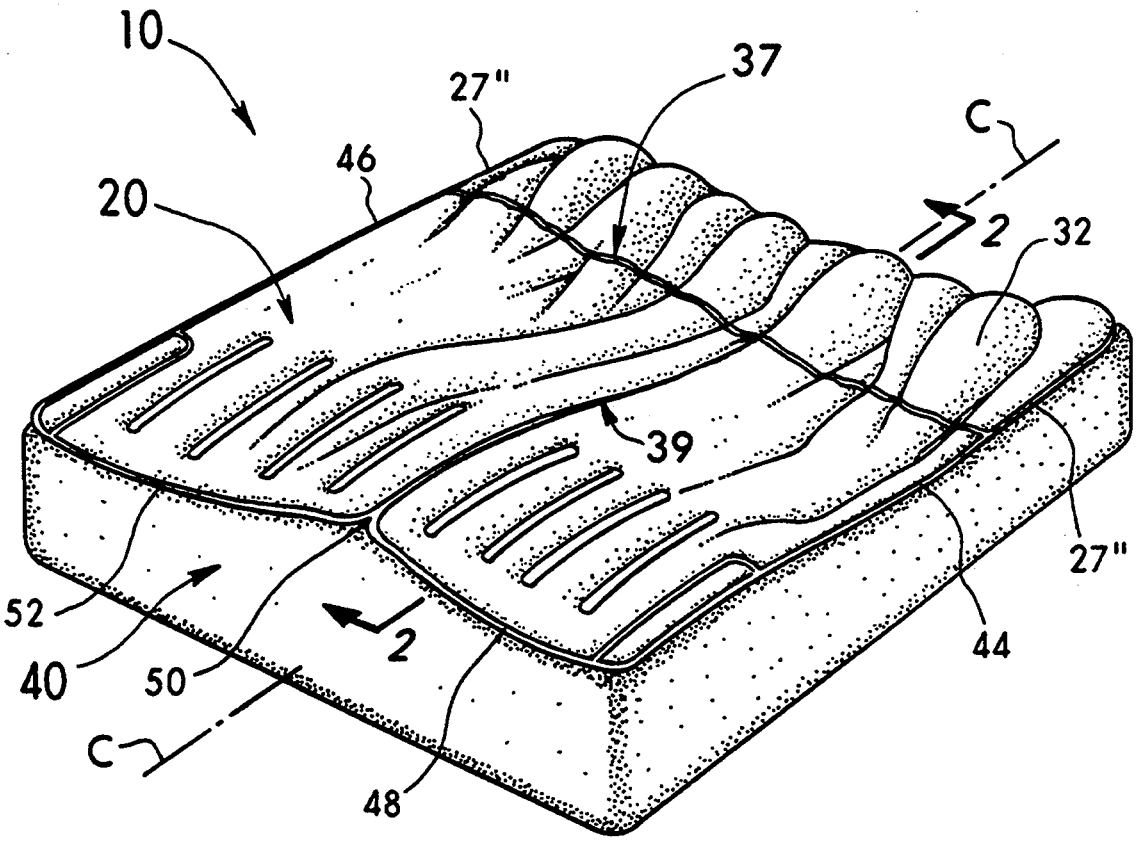
FIG. 1 is an isometric view of the seat cushion combination of the present invention illustrating the pad in place and combined with the tray.

The seat cushion combination 10 is shown generally in FIG. 1. Seat cushion 10 is generally comprised of pad 20 and tray or base member 40.

Figure 2:
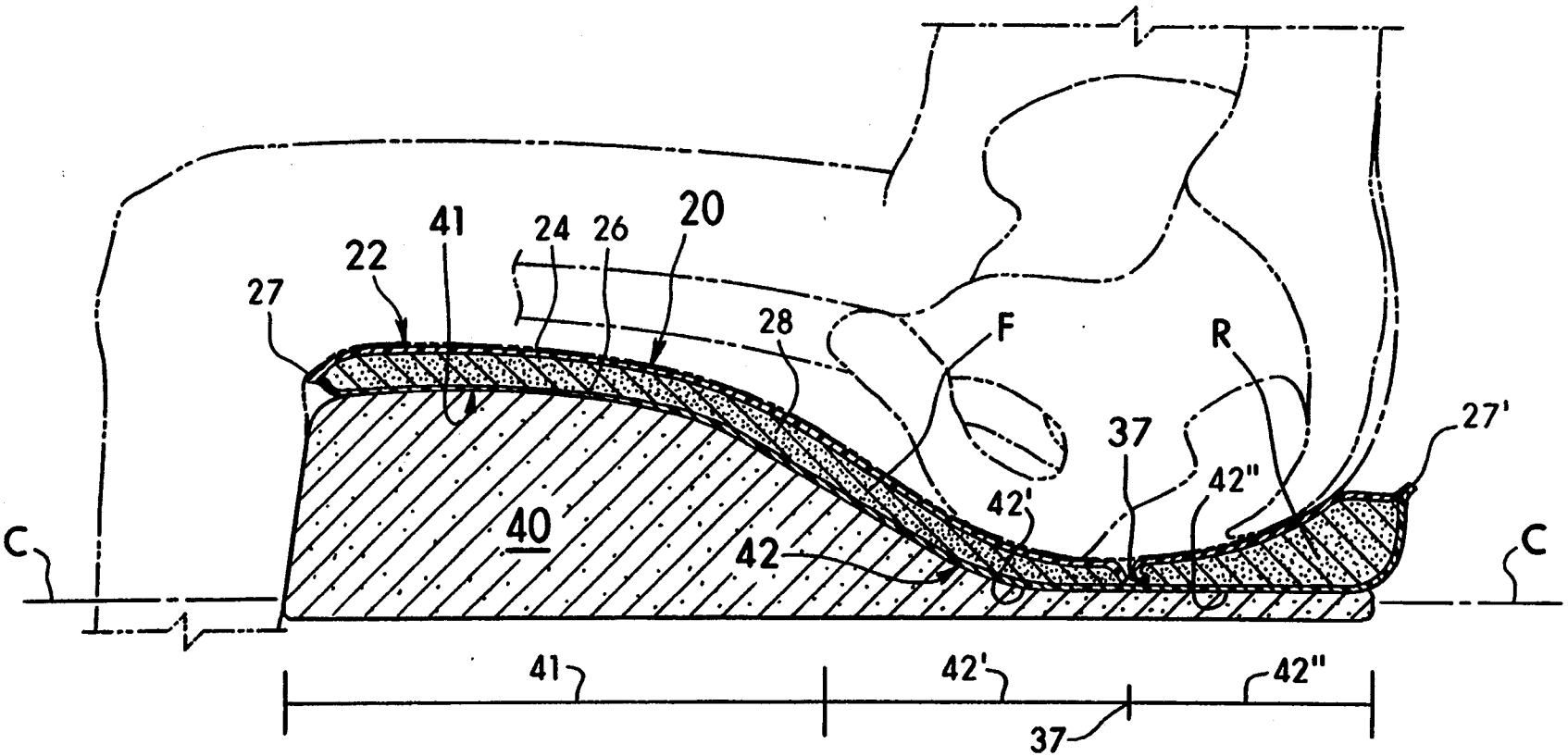
FIG. 2 is a cross sectional side view of the seat cushion combination taken at section 2—2 of FIG. 1.
Figure 3:
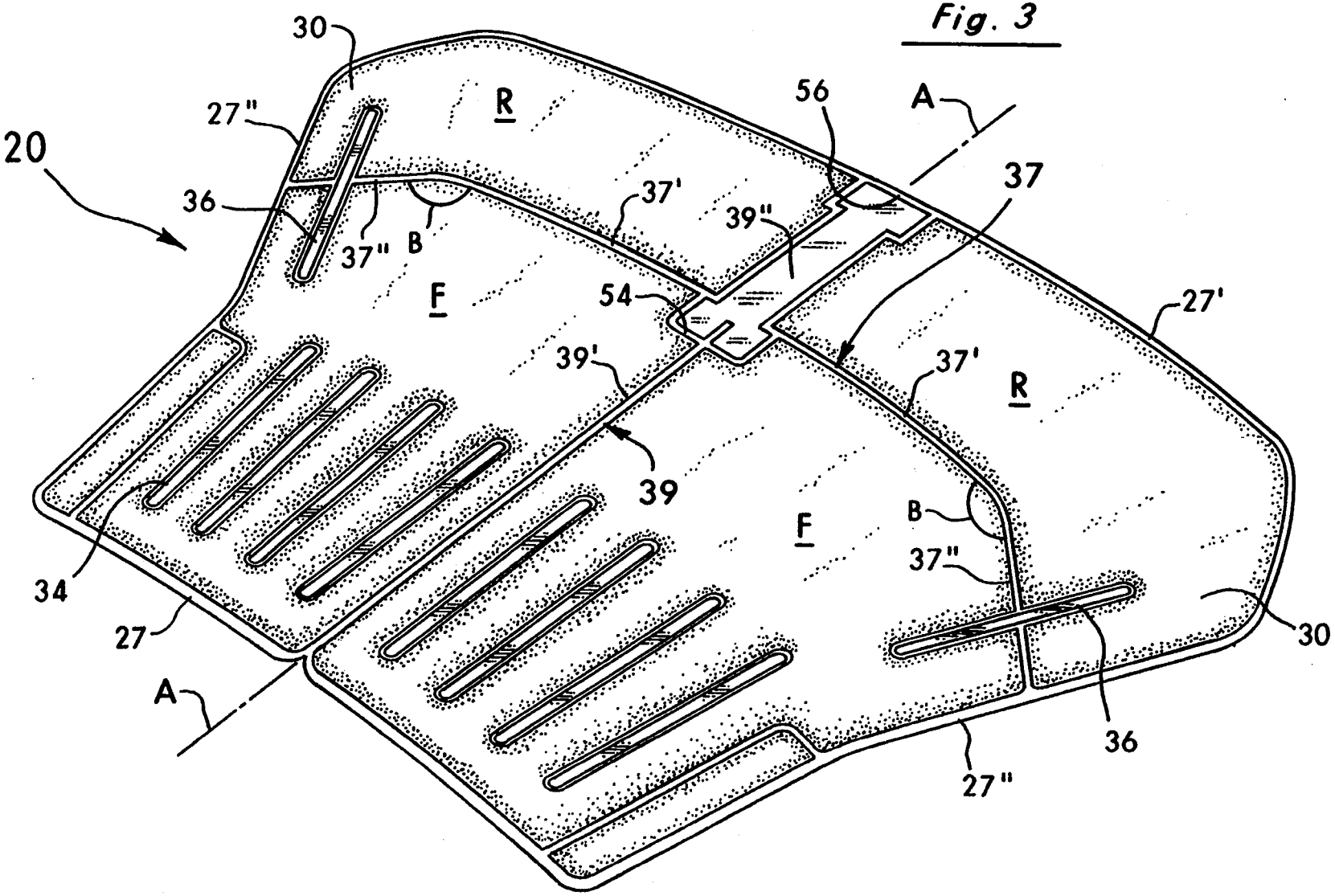
FIG. 3 is an isometric view of the pad combination of the seat cushion illustrating the pad in a spread-out position.

Pad 20, which is shown in section in FIG. 2, comprises an envelope 22 which may be constructed by two layers of flexible films, upper surface 24 and lower surface 26. Envelope 22 is adapted to contain fluid filling material 28. Envelope 22 may be manufactured by heat-sealing flexible films 24 and 26 at the edges with front, rear, and side heat seals 27, 27', and 27" to contain the fluid 28 material therein, as is shown in FIG. 3. In the preferred embodiment the upper flexible film 24 is fabricated from an extensible, elastomeric material, such as a thermoplastic polyurethane.

The Envelope

The envelope 22 is adapted to contain the fluid filling material 28, and depending upon the nature of the fluid used, variations may be necessary to the composition or structure of the envelope. In the preferred embodiment, wherein the fluid filling material is a viscous thixotropic material which flows gradually when pressure is applied to it, but which maintains its shape and position in the absence of pressure, the envelope may be made of flexible sheets of thermoplastic film. It is essential that the envelope be flexible at ambient room temperatures of use. Desirably each layer of the envelope may be made of one or more layers of films of thermoplastic materials, such as thermoplastic polyurethane films.

In the preferred embodiment, it is essential that the upper layer of the envelope be an extensible elastomer so that it is readily stretchable under fairly light pressure, which avoids the hammocking problem described above, It is generally preferred to use a thermoplastic material having a 300% modulus no higher than about 1,800 psi with a tensile strength at break of at least 9,000 pounds. It has been found that envelopes produced from such materials in films of 5 mils thickness produced highly desirable, stretchable envelopes which avoid or minimize the hammocking problem encountered by the prior art, but which are strong enough to prevent accidental punctures.

It has also been found that two layers of 5 or 6 ml. polyurethane films, disposed parallel to one another, provide a surface which is readily pliable but which has great durability. Such double thickness films have been found useful when combined with thicker films for lower envelope surfaces. For example, it has been found that a good envelope is produced from two 6 ml. films as the upper surface and one 10 ml. film as the lower surface.

As was mentioned above, in the most preferred embodiment it is preferred to have an excess of film or material in the upper surface of the envelope as compared to the overall width of the tray. The extensions 30, as shown in FIG. 3 of the drawings, are fabricated by using wider films for both the upper and lower surfaces of the envelope. Alternatively, the envelope may be constructed with the lower surface more or less conforming to the width of the tray or desired cushion area, and with the upper surface being wider than the width of the tray or the intended cushion area. This will provide an envelope with pleat-like wrinkles, similar to the configuration shown in FIG. 1.

Generally speaking, any excess material in the upper surface of the envelope will provide some reduction in hammocking, but it is desired that the overall width of material in the upper surface be at least 25% greater than the width of the tray to which the envelope is attached. Obviously, the excess material in the upper surface of the envelope is adapted to cooperate with the elastomeric upper surface to synergistically avoid the hammocking problem with the resulting pressure build-up points.

The envelopes used to produce the pads of the present invention are preferably heat sealable at the edges, and are adapted to retain the fluid filling material within a defined environment. It has been found that suitable thermoplastic polyurethane films have a thickness of about 0.004 to 0.015 inch and Durometer hardness (Shore A Scale) of 85 or lower. Commercially available polyurethane films have tensile strength in the range of 6,000–9,000 psi, a typical 300% modulus of 1,800 to 2,800 psi and a typical elongation at break of 400 to 650%. The two sheets of film 24 and 26 are connected by being securely heat sealed together at 27, 27', and 27" so as to seal and retain in place the fluid material 28 within the envelope enclosure formed between the sheets. The upper and lower films 24 and 26 may each be made up of plural layers of thermoplastic films or other materials, in order to improve strength, or heat sealing or the like.

In the preferred embodiment, at least the upper flexible film 24 is an extensible elastomer, e.g., it is produced from a polyurethane material having a 300% modulus of no greater than about 2,600 psi. Films having a tensile strength of at least 6,000 psi are strong enough to avoid accidental tears and punctures. When such a film is used in 5 mil thicknesses, it permits a highly desirable extensibility of the envelope which reduces the pressure over the bony prominences of the body and thus reduces the likelihood of pressure sores.

In the preferred embodiment, the pad 20 includes lateral extensions 30 which extend outward from the center of pad 20 at the rearward portion of the pad as shown in FIG. 3. Extensions 30 function to provide additional film for the envelope in the form of rough pleats as shown in FIG. 1, and thus permit the user to avoid any hammocking problem. The lateral extensions 30 in extended form are clearly visible in FIG. 3 and the resulting pleats 32 are illustrated in FIG. 1. The pleated structure may obviate the need to use an elastomeric flexible film 24, in pad 20. In the preferred embodiment, an elastomeric film 24 is combined with the lateral extensions 30.

If desired, one may choose to first heat seal the envelope for the fluid filling material, but leave a small vent opening and/or a small filling port (not shown), so that a predetermined amount or volume material (the fluid may be advantageously heated prior to injection) may be injected into the envelope enclosure through the filling port, followed by heat sealing both the vent opening and filling port. Alternatively, the envelope may be filled to a given level, and the ports used to increase or decrease the amount of fluid filling material.

The Fluid Filling Material

In its broadest aspect, the present invention contemplates use of any fluid material to fill the pad, as described above. However, it is preferred to employ as the fluid a highly viscous liquid, i.e., plastic or viscous thixotropic material, which flows gradually when pressure is applied to it, but which maintains its shape and position in the absence of pressure. One such viscous fluid is commercially available under the trade name FLOLITE, the registered mark of Alden Laboratories. Suitable flowable materials are described and claimed in the U.S. patents below, with are incorporated by reference herein:

U.S. Pat. Nos. 3,237,319 3,402,411 3,635,849 3,798,799 4,038,762 4,083,127 4,108,928 4,144,658 4,229,546 4,243,754 4,255,202 4,728,551

The Segments

In the preferred embodiment, the pad is segmented along the front by heat seals 34 and along the sides by heat seals 36. The segmenting heat seals 34 and 36 affix top film 24 to bottom film 26 in selected areas or at selected points. The segmenting accomplished by the heat seals function to limit the distance the top film 24 can move away from bottom film 26 in selected areas, and thus limits the volume of filling material which may flow into selected areas of the pad, and thus limit the overall thickness of the pad in selected areas. Because the segmenting functions to limit the amount of flowable filling material which may be contained in selected areas, the balance of the flowable filling material remains in the unsegmented sections of the envelope front and rear portions F and R which are designed to support the ischia. As it is shown in FIG. 3, the front area of the pad 20 includes a plurality of segmenting heat seals 34, which run from near the front 27 of the pad, rearwardly and parallel to the direction of the user's legs. These segments define the area over which the user's legs pass. Because the legs cover a relatively limited area of the width of the front section of the pad, the segmenting caused by heat seals 34 limits the amount of flowable material which may move to the front of the pad, between and around the legs. This forces the balance of the flowable material to stay in the seat area 42, an thus reduces the possibility that the user will bottom-out.

Similarly, heat seals 36 at the sides segment the sides and prevents an undesirably great portion of flowable filling material from moving to the outside edge of the cushion. The segmenting of the pad reduces the volume of fluid filling material necessary to avoid "bottoming-out" and thus reduces the weight of the complete seat cushion.

The pad of the present invention includes a transverse neat seal 37 which runs between sides the 27'' divides the rear of the envelope from the front portion of the envelope. Heat seal 37 functions to prevent the flowable filling material in the rear unsegmented portions R of envelope 20 from flowing forward into the front unsegmented portion F of envelope 20. FIG. 3 illustrates transverse heat seal 37 in a more or less arcuate shape opening or facing toward the front 27 of the pad 20. As shown in FIG. 3, the seal 37 has a central segment 37' and two end segments 37'' forming an overall substantially U-shaped configuration with the central segment 37' forming the base of the U-shape and the end segments 37'' forming the legs of the U-shape. As illustrated, each end segment 37'' extends outwardly of the central segment 37' at an obtuse angle B less then 180 degrees. Additionally, as illustrated, each end segment 37'' extends across and essentially bisects each of the segmenting seals 36 wherein the seals 36 then extend into the front and rear portions (F, R) of each respective left and right half of the pad 20. In the preferred embodiment as shown in FIG. 3, the first or center seal 39 has forward and rearward portions 39' and 39''. The forward portion 39' of seal 39 extends along the axis A for a distance substantially greater than the distance of the rearward portion 39''. Additionally, as shown in FIG. 3, the second or transverse seal 37 crosses the wider, rearward portion 39'' of the first seal 39 at a location along the first axis A and seal 39 spaced from the front 27 of the pad 20. Transverse seal 37 also crosses seal 39 at a location spaced from the forward portion 39'of the seal 39 and this crossing location as illustrated is substantially closer to the forward end 54 than to the rearward end 56 of the wider portion 39' of the central seal 39. In further reference to the arcuate shape of the seal 37 and as shown in FIGS. 1 and 3, the pad 20 in use is gathered by bringing the sides 27'' (which normally flare outwardly of each other and outwardly of the pad's central axis A) toward each other until the arcuate seal 37 of FIG. 3 assumes a substantially straight line as shown in FIG. 1. Once so gathered the pad 20 is then placed or positioned over the base member 40 as also shown in FIG. 1 with the sides 27'' of the pad 20 extending substantially parallel to sides 44, 46 and central axis C of the base member 40. Those skilled in the art will understand that other configurations for the heat seal 37 may be adapted to prevent the filling material 28 from flowing forward from rear portions R to front portions F of envelope 20.

It is preferred to provide the pad 20 with a center heat seal 39 which runs along the axis A from the front edge 27 to the rear edge 27' of the pad 20 and which, in effect, divides the pad longitudinally into a left half and a right half. The center heat seal 39 avoids the possibility of the fluid filling material migrating out of one side (due to the user leaning to one side) and assures that both sides of the pad contain equal amounts of fluid filling material. In this manner, seals 37 and 39 serve to effectively divide the pad 20 into four pouches substantially filled with fluid with the fluid in each pouch isolated or sealed from the fluid in the other pouches by seals 37 and 39.

The Shaped Tray

Tray or base member 40 is preferably a relatively rigid, but lightweight material. While urethane foams of various density have been employed, the tray could be manufactured from any convenient material such as plastic, wood, metal, or the like. The tray must be wide enough to support a human being. Trays of about 15.5 inches or 18 inches width are suitable because they fit most persons and may be used in standard size wheelchairs. Smaller sizes, such as 12 inch or 14 inch width may be fabricated for children. The invention is not limited to any specific size.

The shape of the tray or base member 40 as shown extends along a central axis C between the front and rear of the base member 40 and has forward and rearward sections. The forward section has an upper surface 41 forming a shelf to support the user's thighs and the rearward section has a depressed seating well 42 with front and rear, upper surface portions 42' and 42" to receive and support the user's buttocks. Additionally, as illustrated in FIG. 2, the front, upper surface portion 42' of the rearward section is dimensioned and intended to support a substantial portion of the front of the user's buttocks (e.g., half or more of the user's entire buttocks). The adjacent, rear portion upper surface 42" of the rearward section is then dimensioned and intended to support the remaining, rear portion of the user's buttocks.

In use, the pad 20 is positioned over the base member 40 with the axis A and center seal 39 of the pad 20 substantially aligned with the central axis C of the base member 40. Additionally, the pouch of the front portion F of each half of the pad 20 is respectively positioned to overlie the thigh supporting surface or shelf 41 of the forward section of the base member 40 and to overlie the front upper surface or portion 42' of the rearward section of the base member 40. The pouch of the rear portion R of each half of the pad 20 is then positioned to overlie the rear upper surface or portion 42" of the rearward section of the base member 40. In this manner, the user's thighs and a substantial portion of the front of the user's buttocks are respectively supported on the upper surface 41 of the forward section of the base member 40 and the upper surface 42' of the rearward section of the base member 40. The remaining, rear portion of the user's buttocks is then supported on the rear portion 42" of the rearward section of the base member 40.

It is generally critical and essential to have depressed, seat area or seating well 42 surrounded by rims 44 and 46 on each side and rim 48 on the front. A modified front rim 48 is preferably deeper, i.e., extended from a front edge approximately 40% of the distance of the back edge of the tray, with a central rise 50 adapted to spread the users legs and urge the users legs into support areas 52. It is essential that a rear portion of the tray may be open, i.e., no rim at the back in order to avoid building pressure in the area of the coccyx. Because the distance between the ischial tuberosities in adults is between 4.5 and 6 inches, the cutout at the rear of the tray must be at least 6 inches wide, and is preferably at least 8 inches wide in order to provide for a certain amount of shifting from side to side of the user of the cushion. Generally it is desired that the person have from 1 to 3 inches room to shift from side to side and from 1 to 5 inches room to shift from front to back. This allows the user to shift position without developing any undesired pressures from the tray.

As shown in FIG. 1, the side rims 44 and 46 are essentially vertical on the outside of tray 40, but are sloped inwardly, generally toward the seat portion 42 on the inside of the tray. Further details are shown in Applicant's U.S. Pat. Nos. 4,588,229 and 4,726,624, which are incorporated by reference herein. The sloping of the rims prevents the unchecked movement of the fluid filling material away from the body. Similarly, the front rim 48 is relatively vertical on the outside at tray 10, but slopes gradually inwardly and downwardly toward the seating area 43, on the inside of the tray. The inward sloping of side rims 44 and 46 combined with inward sloping of front rim 48 causes the main body of the flowable filling material to remain adjacent to seating area 42.

The arrangement of rims 44, 46 and 48 causes the flowable filling material to build up pressure along the sides of the user's body, and thus distribute the weight of the body over a Large area wherein pressure developed is uniformly low.

The pad need not be attached to the tray, but attachment is preferred.

The present invention contemplates the use of a layer of aluminum foil or other metal foil, adapted to transmit heat, over the surface of the tray. Such a foil layer is adapted to transmit the heat of the user's body away from the cushion area and thus avoid an undesired increase of body temperature in that area. The aluminum foil may be cooled externally to facilitate this function.

As was mentioned above, the pad may be designed to adjust the amount of fluid filling therein. Although adjustment of the amount of filling is not usually required when the filling is a thixotropic type material, such as that sold under the trade name FLOLITE, but adjustment may be required if a gaseous fluid is employed to fill the pad.

The forms of invention shown and described herein are to be considered only as illustrative. It would be apparent to those skilled in the art that numerous modifications may be made therein without departing from the spirit of the invention or the scope of the appended claims.

What is claimed is:

1. A seating system including:

a base member (40) having a front and rear, said base member extending along a central axis (C) between said front and rear, and base member (40) having a forward upper surface (41) forming a shelf to support a user's thighs and having a rearward, depressed seating well (42) with an upper surface (42', 42") to receive and support the user's buttocks including the user's ischial tuberosities and coccyx, said upper surface of said seating well (42) having a front portion (42') dimensioned to receive and support a substantial portion of the front of the user's buttocks and having an adjacent rear portion (42") dimensioned to receive and support the remaining, rear portion of the user's buttocks, a pad (20) substantially filled with fluid and having a front (27) and rear (27') with a first, center seal (39) extending substantially along a first axis (A) from the front (27) to the rear (27') of said pad and substantially dividing said pad into left and right sides, said pad further including a second seal (37) extending substantially across said first seal (39) at a location substantially closer to the rear (27') of said pad than the front (27) of said pad and further dividing each left and right side into a front portion (F) forward of said second seal (37) toward the front (27) of said pad and a rear portion (R) rearward of said second seal (37) toward the rear (27') of said pad, each respective front portion (F) of each side of said pad being substantially larger than the respective rear portion (R) of each side, each front portion (F) and rear portion (R) of each side respectively forming a pouch substantially filled with fluid with the fluid in each pouch being isolated from the fluid in the other pouches by said first and second seals (39, 37) wherein said fluid pad (20) is positioned over said base member (40) with the first axis (A) and the first, center seal (39) of said pad substantially aligned with the central axis (C) of said base member and the pouch of the front portion (F) of each side of said pad respectively overlying at least a substantial part of said thigh supporting shelf surface (41) of said base member and at least a substantial part of the upper surface (42') of the front portion of said seating well (42) and with the pouch of the rear portion (R) of each side of said pad respectively overlying at least a substantial part of the upper surface (42'') of the rear portion of said seating well (42) wherein the user's thighs and said substantial portion of the front of the user's buttocks are both supported on the fluid pouches of the front portions (F) of the pad (20) respectively over the forward upper surface (41) of the base member (40) and over the upper surface (42') of the front portion of the seating well (42) of the base member (40) and wherein the remaining, rear portion of the user's buttocks is supported on the fluid pouches of the rear portions (R) of the pad over the upper surface (42'') of the rear portion of the seating well (42) of the rearward section (RS) of the base member (40).

2. The seating system of claim 1 wherein said second seal (37) is arcuate.

3. The seating system of claim 2 wherein said arcuate, second seal (37) opens facing toward the front (27) of said pad (20).

4. The seating system of claim 3 wherein said arcuate, second seal (37) has a central segment (37') and two end segments (37'').

5. The seating system of claim 4 wherein said arcuate, second seal (37) is substantially U-shaped with the central segment (37') forming the base of said U-shape and said end segments (37'') forming the legs of said U-shape.

6. The seating system of claim 4 wherein each end segment (37'') extends outwardly of said central segment (37') and forwardly of said central segment (37') toward the front (27) of said pad (20) at an obtuse angle (B) less than 180 degrees.

7. The seating system of claim 4 wherein said pad (20) further includes a segmenting seal (36) extending across each respective end segment (37'') of said arcuate, second seal (37) and extending into each respective front portion (F) and rear portion (R) of each respective side of said pad.

8. The seating system of claim 1 wherein said first seal (39) of said pad (20) has a forward portion (39') and a rearward portion (39''), said forward and rearward portions of said first seal extending adjacent one another along said first axis (A) with said forward portion (39') of said first seal (39) extending for a distance along said first axis (A) substantially greater than said rearward portion (39'').

9. The seating system of claim 8 wherein said second seal (37) across said first seal (39) across said rearward portion (39') of said first seal (39).

10. The seating system of claim 8 wherein said second seal (37) crosses said first seal (39) across said rearward portion (39') at a location spaced from the forward portion (39') of said first seal (39).

11. The seating system of claim 10 wherein said rearward portion (39'') of said first seal (39) extends along said first axis (A) for a first distance from a front end (54) to a rear end (56) and said second seal (37) crosses said rearward portion (39'') of said first seal (39) at a location spaced from said front end (54) and substantially closer to said front end (54) than to said rear end (56) of said rearward portion (39'') of said first seal (39).

12. The seating system of claim 1 wherein said pad (20) is positioned on said base member (40) with said transverse seal (37) of said pad extending across said base member substantially closer to the rear of said base member than to the front of said base member and substantially midway across the seating well (42) of the base member (40).

13. The seating system of claim 1 wherein each front portion (F) on each side of said pad (20) further includes four and only four segmenting seals (34) positioned substantially adjacent the front (27) of said pad and extending along said first, center axis (A).

14. The seating system of claim 1 wherein said pad has four and only four pouches.

15. The seating system of claim 1 wherein said fluid is a highly viscous liquid.

16. A fluid pad (20) primarily intended for use in a seating system to support a user's thighs and buttocks including the user's ischial tuberosities and coccyx, said pad being substantially filled with fluid and having a front (27) and rear (27') with a first, center seal (39) extending substantially along a first axis (A) from the front (27) to the rear (27') of said pad and substantially dividing said pad into left and right sides, said pad further including a second seal (37) extending substantially across said first seal (39) at a location closer to the rear (27') of said pad than the front (27) of said pad and further dividing each left and right side into a front portion (F) forward of said second seal (37) toward the front (27) of said pad and a rear portion (R) rearward of said second seal (37) toward the rear (27') of said pad, each respective front portion (F) of each side of said pad being larger than the respective rear portion (R) of each side, each front portion (F) and rear portion (R) of each side respectively forming a pouch substantially filled with fluid with the fluid in each pouch being isolated from the fluid in the other pouches by said first and second seals (39, 37), said front portions (F) of each side of said pad being dimensioned to support at least a portion of the user's thighs and a substantial portion of the front of the user's buttocks, said rear portions (R) of each side of said pad being dimensioned to support the remaining, rear portion of the user's buttocks.

17. The fluid pad of claim 16 wherein said second seal (37) is arcuate.

18. The fluid pad of claim 17 wherein said arcuate, second seal (37) opens facing toward the front (27) of said pad (20).

19. The fluid pad of claim 18 wherein said arcuate, second seal (37) has a central segment (37') and two end segments (37'').

20. The fluid pad of claim 43 wherein said arcuate, second seal (37) is substantially U-shaped with the central segment (37′) forming the base of said U-shape and said end segments (37″) forming the legs of said U-shape.

21. The fluid pad of claim 19 wherein each end segment (37″) extends outwardly of said central segment (37′) and forwardly of said central segment (37′) toward the front (27) of said pad (20) at an obtuse angle (B) less than 180 degrees.

22. The fluid pad of claim 19 wherein said pad (20) further includes a segmenting seal (36) extending across each respective end segment (37″) of said arcuate, second seal (37) and extending into each respective front portion (F) and rear portion (R) of each respective side of said pad.

23. The fluid pad of claim 16 wherein said first seal (39) of said pad (20) has a forward portion (39′) and a rearward portion (39″), said forward and rearward portions of said first seal extending adjacent one another along said first axis (A) with said forward portion (39′) of said first seal (39) extending for a distance along said first axis (A) substantially greater than said rearward portion (39″).

24. The fluid pad of claim 23 wherein said second seal (37) crosses said first seal (39) across said rearward portion (39″) of said first seal (39).

25. The fluid pad of claim 23 wherein said second seal (37) crosses said first seal (39) across said rearward portion (39″) at a location spaced from the forward portion (39′) of said first seal (39).

26. The fluid pad of claim 25 wherein said rearward portion (39″) of said first seal (39) extends along said first axis (A) for a first distance from a front end (54) to a rear end (56) and said second seal (37) crosses said rearward portion (39″) of said first seal (39) at a location spaced from said front end (54) and substantially closer to said front end (54) than to said rear end (56) of said rearward portion (39″) of said first seal (39).

27. The fluid pad of claim 16 wherein each front portion (F) on each side of said pad (20) further includes four and only four segmenting seals (34) positioned substantially adjacent the front (27) of said pad and extending along said first, center axis (A).

28. The fluid pad of claim 16 wherein said pad has four and only four pouches.

29. The fluid pad of claim 16 wherein said fluid is a highly viscous liquid.

30. The fluid pad of claim 16 further including:

a base member (40) having a front and rear, said base member extending along a central axis (C) between said front and rear, said base member having a forward upper surface (41) forming a shelf to support the user's thighs and having a rearward seating area (42) with an upper surface (42′, 42″) to receive and support the user's buttocks including the user's ischial tuberosities and coccyx, said upper surface of said seating area (42) having a front portion (42′) dimensioned to receive and support a substantial portion of the front of the user's buttocks and having an adjacent rear portion (42″) dimensioned to receive and support the remaining, rear portion of the user's buttocks wherein said fluid pad (20) is positioned over said base member (40) with the first axis (A) and the first, center seal (39) of said pad substantially aligned with the central axis (C) of said base member and the pouch of the front portion (F) of each side of said pad respectively overlying at least a part of said thigh supporting shield surface (41) of said base member and at least a substantial part of the upper surface (42′) of the front portion of said seating area (42) and with the pouch of the rear portion (R) of each side of said pad respectively overlying at least a substantial part of the upper surface (42″) of the rear portion of said seating area (42) wherein the user's thighs and said substantial portion of the front of the user's buttocks are both supported on the fluid pouches of the front portions (F) of the pad (20) respectively over the forward upper surface (41) of the base member (40) and over the upper surface (42′) of the front portion of the seating area (42) of the base member (40) and wherein the remaining, rear portion of the user's buttocks is supported on the fluid pouches of the rear portions (R) of the pad over the upper surface (42″) of the rear portion of the seating area (42) of the base member (40).

31. The fluid pad of claim 30 wherein said pad (20) is positioned on said base member (40) with said transverse seal (37) of said pad extending across said base member substantially closer to the rear of said base member than to the front of said base member and substantially midway across the seating area (42) of the base member (40).

* * * * *